US006393854B1

(12) United States Patent
Scheuer et al.

(10) Patent No.: US 6,393,854 B1
(45) Date of Patent: May 28, 2002

(54) EVAPORATION TRAY

(75) Inventors: Ilário José Scheuer; Valter Gamba; Gilberto Heinzelmann, all of Joinville (BR)

(73) Assignee: Empresa Brasileira de Compressores S.A.-Embraco, Joinville-SC (BR)

( * ) Notice: Subject to any disclaimer, the term of this patent is extended or adjusted under 35 U.S.C. 154(b) by 0 days.

(21) Appl. No.: 09/462,738

(22) PCT Filed: May 17, 1999

(86) PCT No.: PCT/BR99/00043

§ 371 (c)(1),
(2), (4) Date: Feb. 9, 2000

(87) PCT Pub. No.: WO99/60314

PCT Pub. Date: Nov. 25, 1999

(30) Foreign Application Priority Data

May 19, 1998 (BR) ..... 9802115

(51) Int. Cl.[7] ..... F25B 47/00
(52) U.S. Cl. ..... 62/277; 62/285

(58) Field of Search ..... 62/277, 285

(56) References Cited

U.S. PATENT DOCUMENTS

| | | | | | |
|---|---|---|---|---|---|
| 5,271,241 | A | * | 12/1993 | Kim | 62/285 |
| 5,881,566 | A | * | 3/1999 | Shacklock et al. | 62/277 |
| 5,941,085 | A | * | 8/1999 | Jeon | 62/151 |
| 5,966,958 | A | * | 10/1999 | Maynard | 62/277 |
| 5,979,172 | A | * | 11/1999 | Teller | 62/305 |
| 6,053,003 | A | * | 4/2000 | Song et al. | 62/285 |
| 6,065,299 | A | * | 5/2000 | Chen | 62/277 |

* cited by examiner

*Primary Examiner*—William Doerrler
*Assistant Examiner*—Mark Shulman
(74) *Attorney, Agent, or Firm*—Darby & Darby

(57) ABSTRACT

The present invention refers to a new construction for the evaporation tray for the defrost water in refrigeration systems of refrigerators and freezers and, more especifically, to a new construction for the evaporation tray of the type which is affixed onto the shell of the hermetic compressor of said refrigeration systems.

4 Claims, 3 Drawing Sheets

EVAPORATION TRAY

FIELD OF THE INVENTION

The present invention refers to a new construction for the evaporation tray for the defrost water in refrigeration systems of refrigerators and freezers and, more especifically, to a new construction for the evaporation tray of the type which is affixed onto the shell of the hermetic compressor of said refrigeration systems.

BACKGROUND OF THE INVENTION

There are well known in the art the constructive solutions for affixing, onto the shell of a hermetic compressor, a tray which is dimensioned to receive and store the water produced by defrost, which usually occurs automatically in refrigerators and freezers. In this constructive solution, seating the tray onto the compressor shell allows the tray to be submitted to the heat produced by the compressor under operation, promoting the evaporation of the collected water.

In one of these known solutions, the shell of the hermetic compressor incorporates an upper support onto which is fitted and retained the evaporation tray, which is, in turn, inferiorly and externally designed, in order to be easily and securely adapted onto the upper support of the compressor shell. Although providing a strong fixation with high mechanical strength, this constructive solution has, as a disadvantage, a relatively high cost due to the provision and fixation of the support onto the shell and due to the specific shape that both the tray and the support must have to guarantee an easy and secure mutual fitting. Two other inconveniences of the solution cited above result from the difficulty of packaging the compressor when its shell incorporates a projecting upper support, and also from the limited thermal contact between the tray and the compressor shell.

In another known solution, the evaporation tray has the lower portion thereof shaped in order to be seated onto a larger area of the compressor shell, the fixation being achieved by means of clamps acting on both the tray and the tubes provided through the shell. Although improving the thermal contact between the shell and the tray, this solution requires more space in the compressor for assembling and disassembling the tray and presents a low versatility, since a determined tray cannot be adapted to different tube diameters.

Besides these two solutions of mechanical fixation cited above, there are other solutions in which adhesion is used for affixing the tray to the shell. In one of these fixations by adhesive, liquid or viscous glue is applied between the shell and the bottom of the tray. Although improving the thermal contact between both parts, dispensing the support in the shell, simplifying the lower profile of the tray and making easy the assembly, the fixation by adhesive has the inconveniences of depending on the amount and distribution of the glue, requiring a certain degree of cleanliness of the surfaces to be glued, and also of allowing the parts to separate from each other, upon heating of the compressor.

In another known solution, the "hot-melt" process is used for attaching the tray onto the compressor shell. The advantages and deficiencies of this solution are similar to those already commented in relation to the use of adhesives.

DISCLOSURE OF THE INVENTION

It is the object of the present invention to provide an evaporation tray for a refrigeration system of refrigerators and freezers, to be mounted onto the hermetic compressor of said system, having a simple and easy construction which can be securely attached to the compressor shell, without requiring the incorporation of additional elements to the latter and assuring a relatively high thermal contact between the tray and the compressor, with no risks of the parts separating from each other, upon heating of the compressor under operation.

The object above is achieved by the provision of an evaporation tray, which is molded in a high temperature resistant plastic material and which is to be seated and affixed onto the upper cover of the compressor shell of the refrigeration system of refrigerators and freezers.

According to the invention, the evaporation tray comprises a bottom wall provided with a lower surface portion, dimensioned to be seated onto the upper cover of the compressor shell; a peripheral wall; and at least one adhesive tape of the double face type, which is simultaneously attachable to said lower surface portion of the tray and onto the upper cover of the compressor shell.

BRIEF DESCRIPTION OF THE DRAWINGS

The invention will be described below, with reference to the attached drawings, in which.

DESCRIPTION OF THE ILLUSTRATED EMBODIMENT

Figure 1:
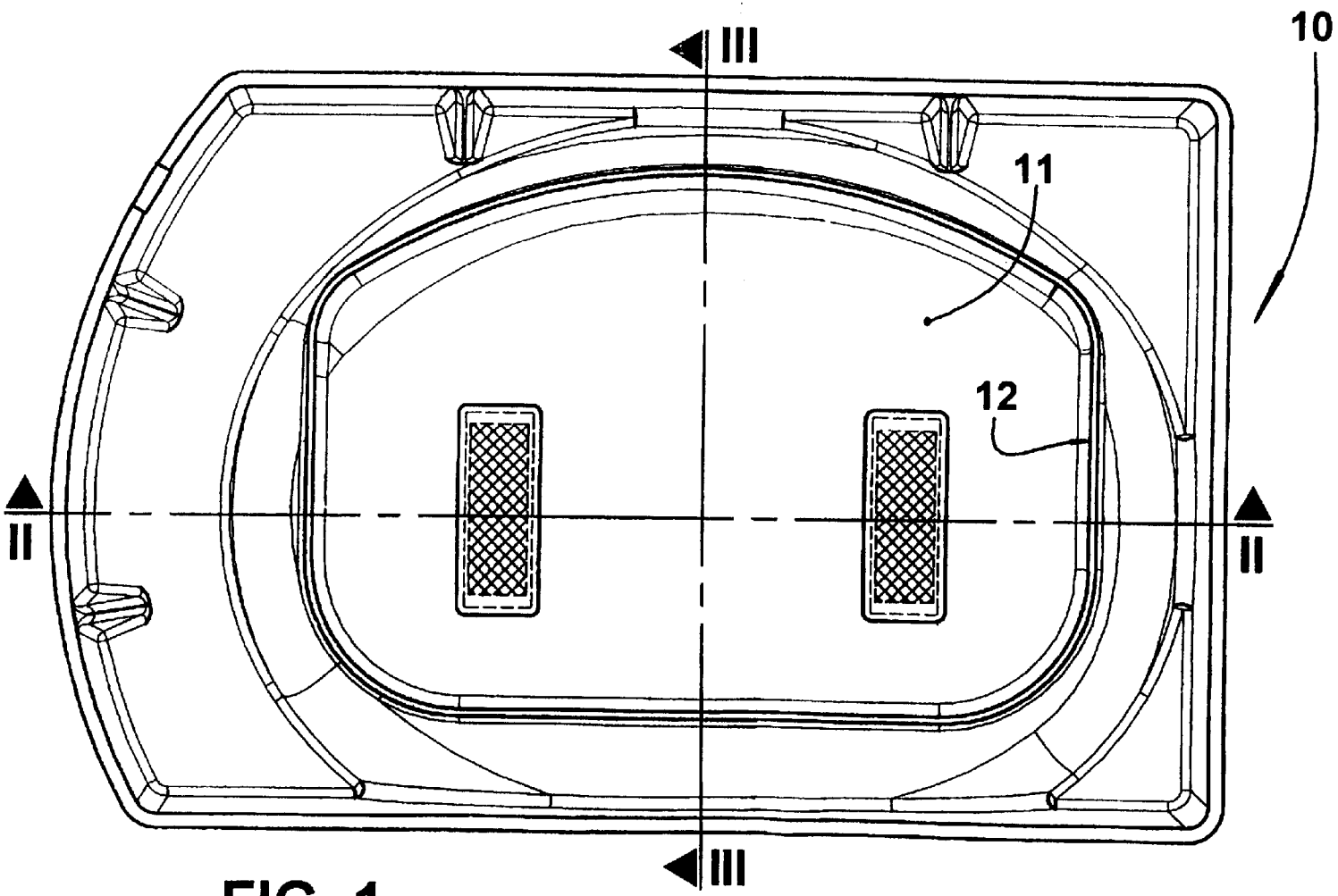
FIG. 1 is a top plan view of the tray of the present invention.
Figure 2:
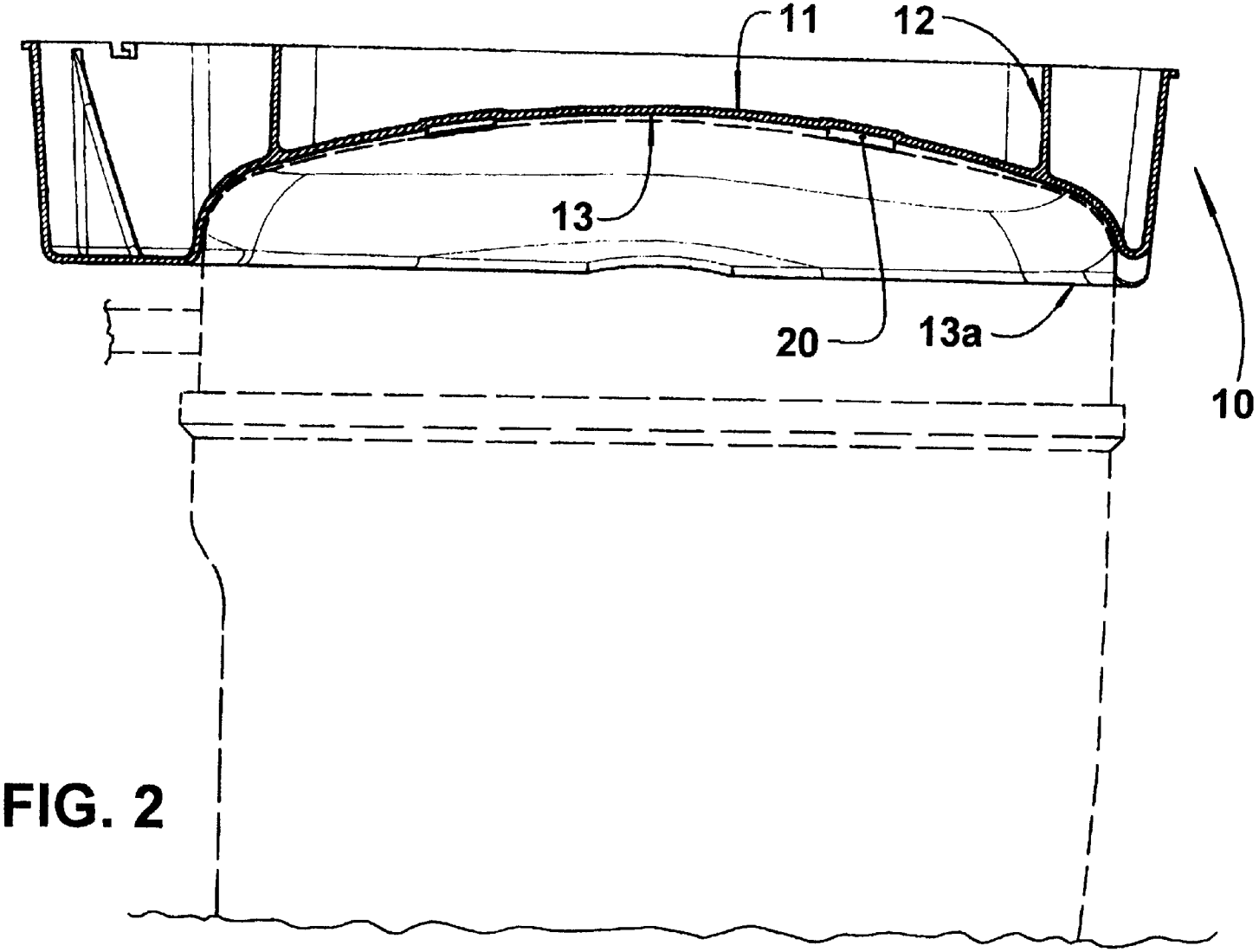
FIG. 2 illustrates a longitudinal sectional view of the tray, taken along line II—II of FIG. 1 and with the tray being seated onto the upper cover of the compressor shell represented in dashed lines.
Figure 3:
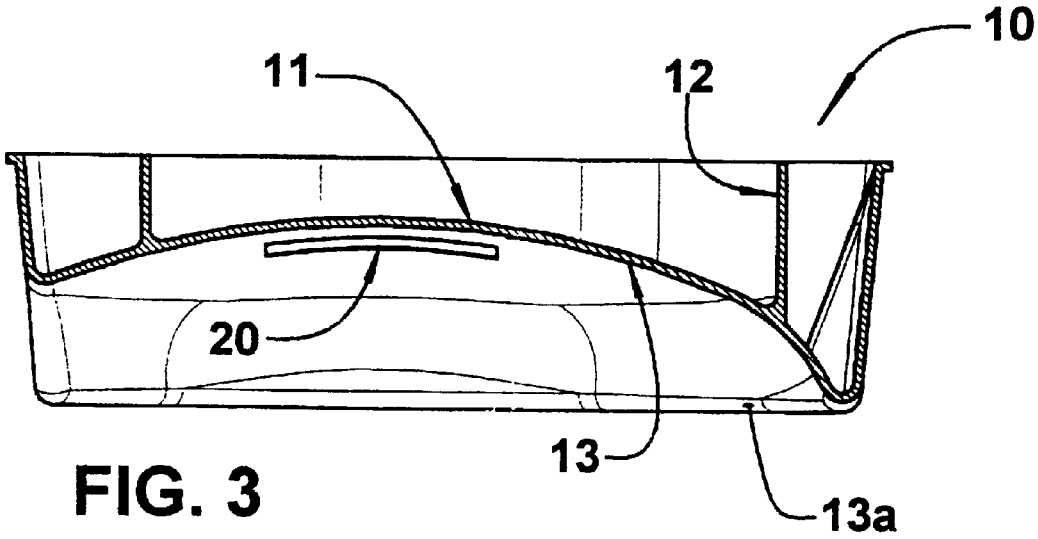
FIG. 3 is a similar view to that of FIG. 2, but taken along line III—III of FIG. 1.
Figure 4:
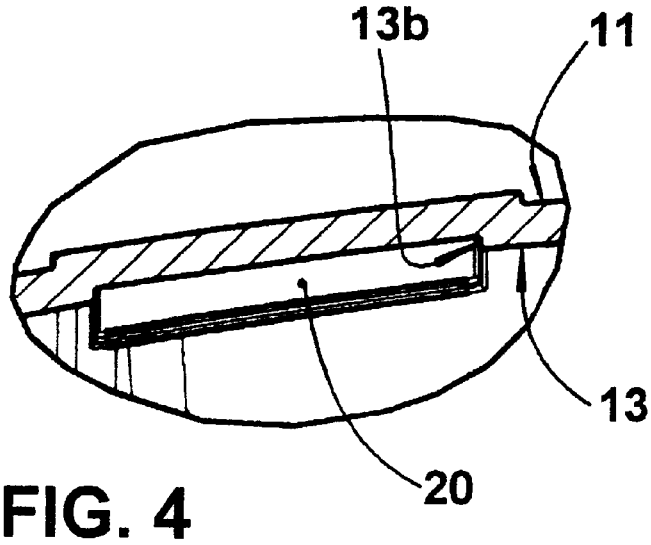
FIG. 4 illustrates an enlarged detail of the fixation of a double face adhesive tape into the lower recess of the tray.

As illustrated in the drawings, the tray 10 of the present invention consists of a single piece, which is usually molded in a high temperature resistant plastic material, such as propilene, resistant to high temperatures up to about 120° C., and which comprises a bottom wall 11 incorporating a peripheral wall 12 with a height sufficient to define the defrost water collecting volume required by the refrigeration system to which said tray will be applied.

The bottom wall 11 is preferably provided with a lower recess 13 dimensioned to allow said bottom wall to be fitted and seated onto the upper cover T of the compressor shell, so that the peripheral edge 13*a* of the lower recess 13 is maintained preferably seated around the surrounding upper edge of the cover T of the compressor shell.

In the illustrated construction, the lower recess 13 is obtained by the upwardly bent shape of the bottom wall 11, which is so shaped in order to follow the contour of the upper portion of the cover T of the compressor shell.

With this construction, it is possible to obtain a stable and direct seating, with a large superficial extension, of the bottom wall 13 of the tray 10 against the cover T of the compressor shell, simplifying the relative positioning during assembly and considerably increasing the thermal exchange between the compressor shell and the tray 10.

Although the provision of the lower recess 13 facilitates the assembly of the tray 10, increases the stability upon positioning the latter and improves the thermal exchange between the compressor and tray, it should be understood that the lower recess 13 may be generically defined as a lower surface dimensioned to be seated onto a certain extension of the end face of the upper cover T of the compressor shell.

In order to attach the tray 10 to the upper cover T of the compressor shell, there is provided at least one adhesive tape 20, of the double face type, which is seated onto a determined place of said lower surface, usually the lower recess 13 of the bottom wall 11 of the tray 10. In the illustrated embodiment, there are two adhesive tapes 20, each seated and affixed into a respective lowered portion 13*b* provided in the lower recess 13, the depth of the lowered portion 13*b* being slightly smaller than the thickness of the adhesive tape 20, in order to allow the other face of the adhesive tape 20 to be slightly outwardly projected, so as to be seated and affixed against the upper cover T of the compressor shell upon assembly of the tray 10. With this construction, the adhesive tapes 20 may simultaneously act against the tray and the compressor shell, allowing the seating of said tray onto the the shell, in order to guarantee an efficient thermal exchange therebetween.

As illustrated in the drawings, the tray 10 may have any additional structural characteristic, aiming at increasing its resistance, without interfering with its assembly onto the compressor or with its capacity of collecting the defrost water of the refrigeration system.

What is claimed is:

1. An evaporation tray to be seated and affixed onto the upper cover of a compressor shell of a refrigeration system of refrigerators and freezers, comprising:

a one-piece molded tray of a plastic material resistant to high temperature having a bottom wall provided with a lower surface portion dimensioned and shaped to be seated onto the upper cover of the compressor shell;

a peripheral wall extending upwardly from said bottom wall; and at least one piece of adhesive tape of the double face type which is simultaneously attachable to said lower surface portion of the tray and onto the upper cover of the compressor shell.

2. An evaporation tray, as in claim 1, wherein said lower surface portion is defined by a lower recess having a peripheral edge to be seated around the surrounding upper edge of the upper cover of the compressor shell.

3. An evaporation tray, as in claim 2, wherein said lower surface portion is of a convex shape of said bottom wall.

4. An evaporation tray, as in claim 1, wherein a said at least one piece of adhesive tape is seated and affixed into a corresponding recessed portion provided in said lower surface portion and having a depth which is slightly less than the thickness of said at least one piece of adhesive tape.

* * * * *